US005791647A

United States Patent [19]

Reiling

[11] Patent Number: 5,791,647

[45] Date of Patent: Aug. 11, 1998

[54] MULTILAYER THREE DIMENSIONAL PUZZLE

[75] Inventor: Victor G. Reiling, Kent, Conn.

[73] Assignee: Rose Art-Warren Industries, Laffayette, Ind.

[21] Appl. No.: 870,760

[22] Filed: Jun. 9, 1997

Related U.S. Application Data

[60] Provisional application No. 60/020,084 Jun. 13, 1996.

[51] Int. Cl.[6] ..... A63F 9/12

[52] U.S. Cl. ..... 273/157 R

[58] Field of Search ..... 273/153 R, 156, 273/157 R, 157 A; 434/365

[56] References Cited

U.S. PATENT DOCUMENTS

| | | | |
|---|---|---|---|
| 1,964,007 | 6/1934 | Parks | 273/157 R |
| 1,997,501 | 4/1935 | Sweney | 273/157 R |
| 2,395,129 | 2/1946 | Lewis . | |
| 3,682,479 | 8/1972 | Miller | 273/157 R |
| 3,692,312 | 9/1972 | Meyer | 273/157 R |
| 4,257,606 | 3/1981 | Launzel | 273/157 R |
| 4,469,331 | 9/1984 | Rinker | 273/157 R |
| 4,815,742 | 3/1989 | Augustine | 273/157 A |
| 4,824,112 | 4/1989 | Roy | 273/157 R |
| 5,165,689 | 11/1992 | Forsse et al. | 273/157 R |
| 5,615,883 | 4/1997 | Stevens | 273/157 R |

*Primary Examiner*—Steven B. Wong
*Attorney, Agent, or Firm*—McCarter & English, LLP; Allen N. Friedman

[57] ABSTRACT

A multilayer three dimensional puzzle includes two or more planar layers supported by separators in a spaced relationship to one another. Each layer consists of assembled interlocking puzzle pieces. Assembled, spaced apart layers form a scene with a three dimensional effect. The assembly forms a rigid self supporting structure that can stand on a horizontal surface or be supported from a single point to hang as a mobile. Each of the puzzle layers can be printed on both sides to increase the assembly challenge and permit viewing from all sides. The three dimensional effect can be accentuated by providing a slight curve to one or more of the layers or dimensioning the separators to place the planar layers at a small angle to one another.

20 Claims, 4 Drawing Sheets

MULTILAYER THREE DIMENSIONAL PUZZLE

This application claims the benefit of the filing date of Provisional application Ser. No. 60/020,084, filed Jun. 13, 1996.

BACKGROUND OF THE INVENTION

1. Field of the Invention

The invention is in the field of recreational puzzles.

2. Background Art

Three dimensional puzzles of several types, assembled from interlocking planar puzzle pieces, have long been part of the recreational art. In many of these puzzles, several planar sections are assembled and fitted together to form a house, a castle or other structure. (See, for example, Roy, U.S. Pat. No. 4,824,112, issued Apr. 25, 1989). In another type of puzzle, layers with shaped peripheries are stacked together to form the desired three dimensional solid body. (See, for example, Launzel, U.S. Pat. No. 4,257,606, issued Mar. 24, 1981 and Parks, U.S. Pat. No. 1,964,007, issued Jun. 26, 1934). In these puzzles the solid body can present a pictorial image if the layer edges are imprinted. In another type of puzzle the layers that are assembled and stacked in contact with one another are all of the same peripheral shape but are provided with apertures so that a portion of the lower layers can be viewed through the apertures in the upper layers, producing an impression of visual depth. (See, for example, Miller, U.S. Pat. No. 3,682,479, issued Aug. 8, 1972 and Augustine, U.S. Pat. No. 4,815,742, issued Mar. 28, 1989). However, puzzle innovators are continually searching for new ways to challenge and attract puzzle enthusiasts.

SUMMARY OF THE INVENTION

The three dimensional puzzle of the invention are both challenging and decorative. It is composed of two or more sections, each with a different pictorial image, each with a different peripheral shape, and, possibly, printed on both sides. When completed, it is a self-supporting display that presents a different appearance from different angles. When the sections are printed on both sides, it can be displayed as a mobile. This multilayer three dimensional puzzle includes two or more planar layers supported by separators in a spaced relationship to one another. Each layer consists of assembled interlocking puzzle pieces. The assembled, spaced apart layers form a scene with a three dimensional effect. The assembly forms a rigid self supporting structure that can stand on a horizontal surface or be supported from a single point to hang as a mobile. Each of the puzzle layers can be printed on both sides to increase the assembly challenge and permit viewing from all sides. The three dimensional effect can be accentuated by providing a slight curve to one or more of the layers or dimensioning the separators to place the planar layers at a small angle to one another.

DETAILED DESCRIPTION OF THE INVENTION

Figure 1:
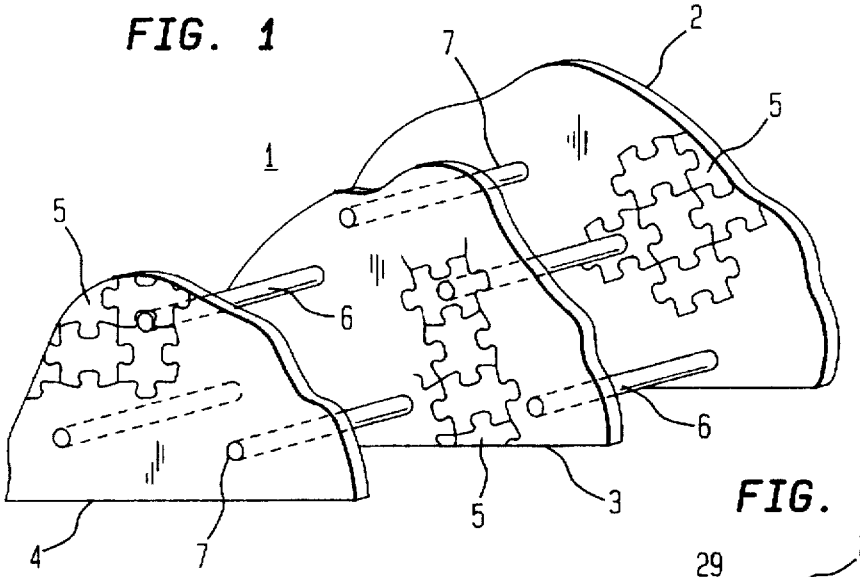
FIG. 1 is an elevational view of an exemplary puzzle of the invention.

FIG. 1 shows a three dimensional, multilayer puzzle of the invention consisting of three planar sections 2, 3, 4 supported in a three dimensionally spaced relationship to one another by separator means in the form of thin rods 6. Each section 2, 3, 4 is assembled from interlocking planar puzzle piece 5. The separator rods 6 are engaged in apertures 7 in the sections 2, 3, 4. The rods 6 are, preferably, sized to produce an interference fit in the holes 7 so that the frictional forces between the rods 6 and the material forming the sections 2, 3, 4 rigidly hold the assembled puzzle. The three dimensional spacing between the sections 2, 3, 4 can be adjusted to accommodate the available display space.

The puzzle pieces 5 and the assembled puzzle sections 2, 3, 4 are fabricated from a material that is thick enough to hold together when assembled and smooth enough to carry an imprinted pictorial image. Exemplary materials include a heavy grade of cardboard, a composition fiberboard or a composite board consisting of a polymeric foam core faced on one or both sides with a flexible sheet material such as paper or thin cardboard. Such puzzles have been fabricated using a composite board with an approximately one quarter inch thick polyethylene foam core bonded on one side to 70 pound smooth white paper. When using interference fit separator rods 6, use of a foam core with some resiliency (semi-rigid) is preferable, since the memory of the core material holds the rod more firmly.

Figure 5:
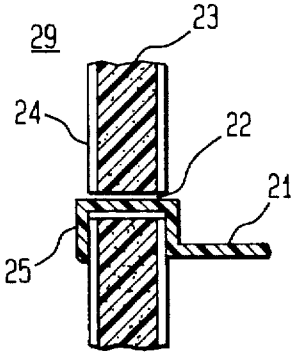
FIG. 5 is an elevational view in section of an exemplary separator member installed through an aperture in a puzzle piece.
Figure 3:
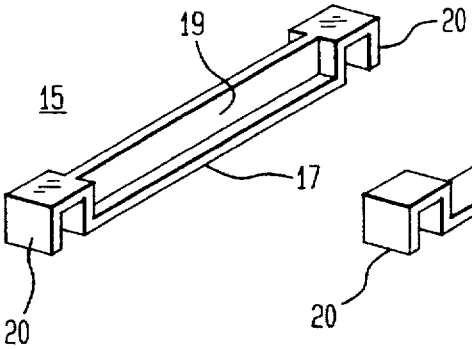
FIG. 3 is a perspective view of an exemplary separator member.
Figure 4:
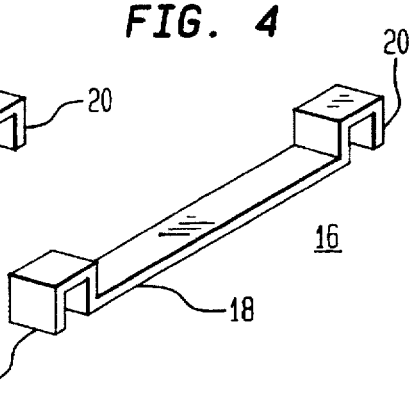
FIG. 4 is a perspective view of an exemplary separator member.
Figure 6:
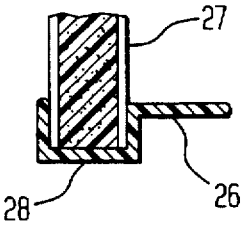
FIG. 6 is an elevational view in section of an exemplary separator member engaging the edge of a puzzle piece.
Figure 2:
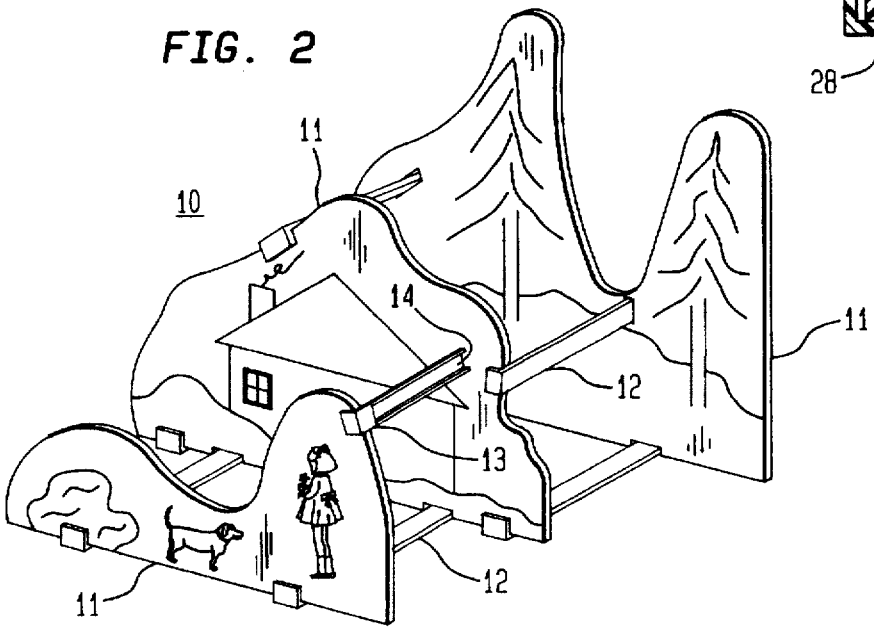
FIG. 2 is an elevational view of an exemplary puzzle of the invention.

FIG. 2 shows a puzzle 10 with three planar sections held by separator rods 12 including molded end clamps 13. FIGS. 3 and 4 show such exemplary separator rods 15, 16 in more detail. The separators include a separator arm 17, 18 and end clamps 20. The FIG. 3 separator 15 includes a web 19 for additional rigidity. Such separators 15, 16 can be fabricated for example, of molded plastic, or molded, bent, or stamped metal. FIGS. 5 and 6 show such separators 21, 26 grasping the edge of a puzzle piece 27 or extending through a hold 22. If separators with end clamps 25, 28 are used, the puzzle pieces can advantageously be made with a stiffer core material, such as polystyrene, since the resiliency can be supplied by the clamp ends 25, 28 of the separators 21, 26. FIG. 5 shows the puzzle piece 29 fabricated of a core 23 and two bonded face layers 24.

Figure 7:
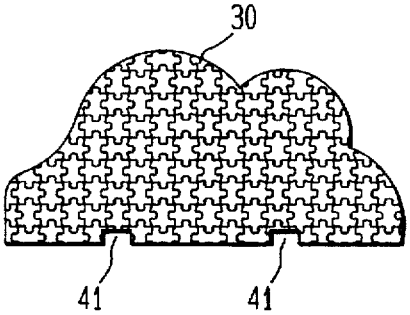
FIG. 7 is plan view of an exemplary planar puzzle section.
Figure 8:
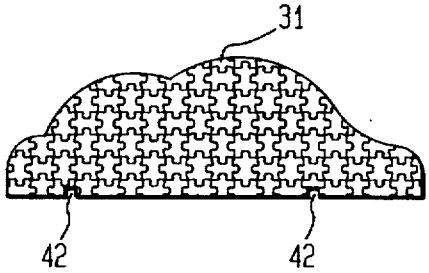
FIG. 8 is plan view of an exemplary planar puzzle section.
Figure 9:
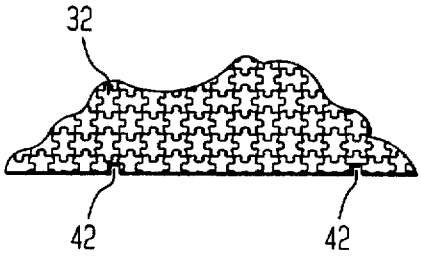
FIG. 9 is plan view of an exemplary planar puzzle section.
Figure 10:
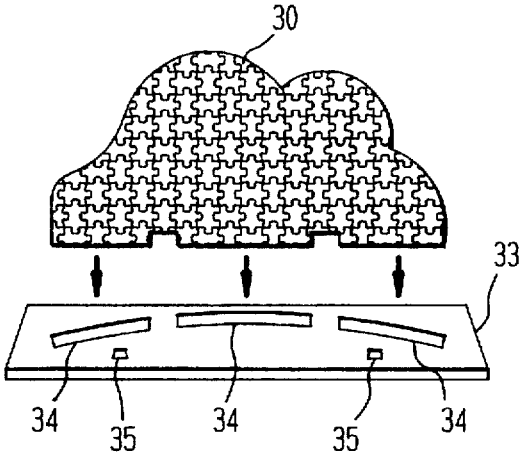
FIG. 10 is an elevational view of the planar section of FIG. 7 being inserted into a separator section with a groove adapted for holding the planar section as a curved plane.
Figure 12:
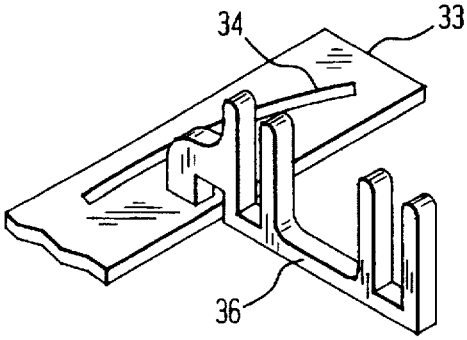
FIG. 12 is a perspective view showing the separator element of FIG. 11 coupled to the separator element illustrated in FIG. 10.
Figure 11:
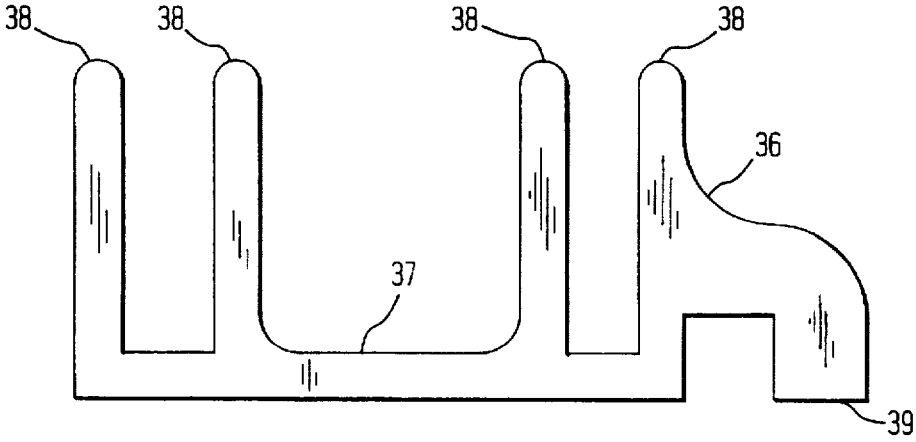
FIG. 11 is an elevational view of an exemplary separator element.
Figure 13:
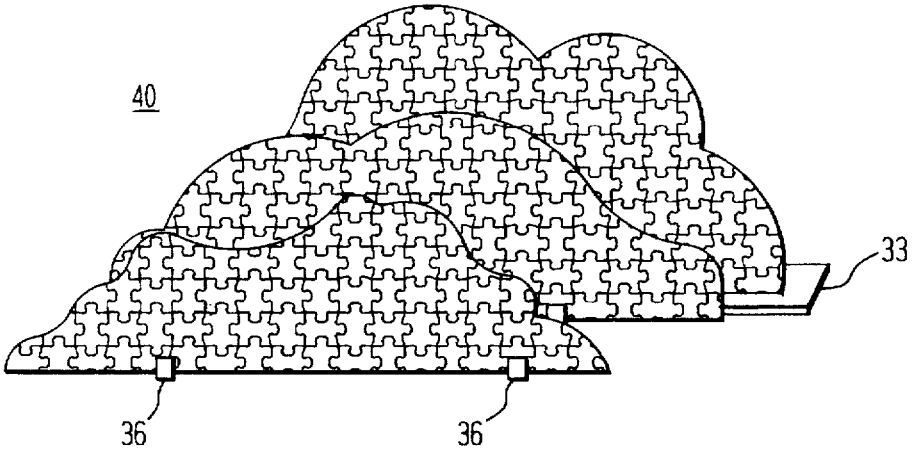
FIG. 13 is a perspective view showing the planar sections of FIGS. 7, 8 and 9 rigidly supported by the separator elements illustrated in FIGS. 11 and 12.
Figure 16:
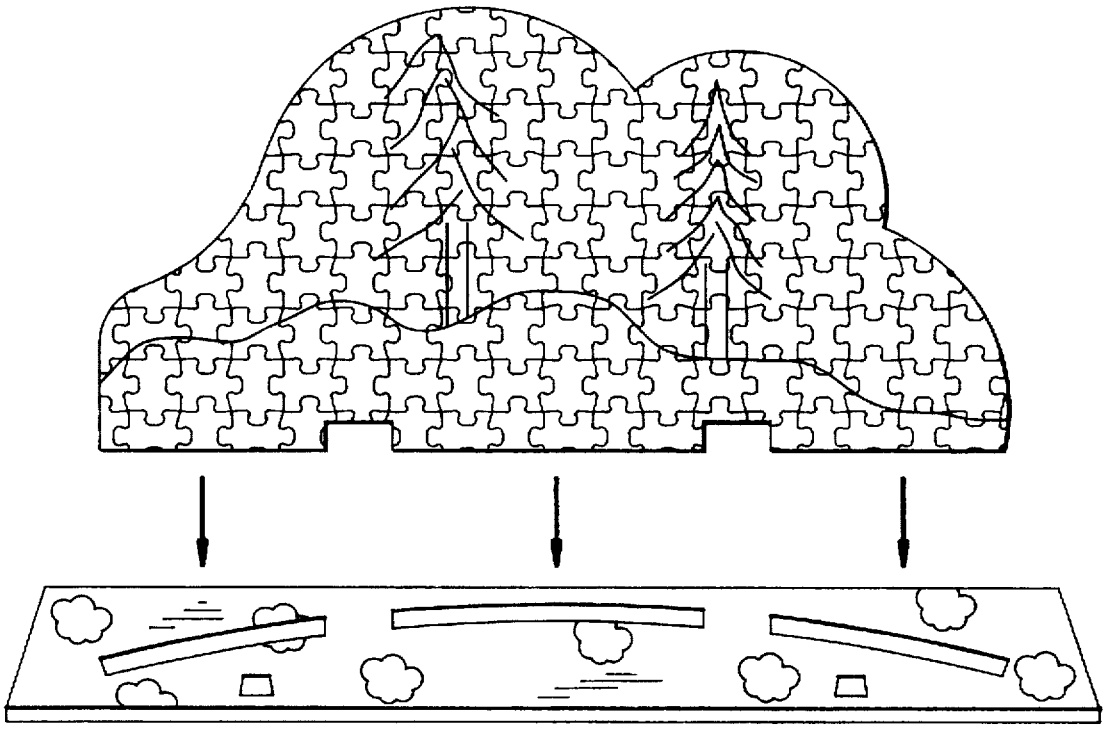
FIG. 16 is an elevational view of a planar section and a separator section of FIG. 10, showing pictorial images on both sections.

FIGS. 7, 8 and 9 show three planar sections of another exemplary puzzle. As illustrated in FIGS. 10, 12 and 13, the separator of this puzzle includes molded elements 36 and a base plate 33 with grooves 34. The grooves 34 engage the lower edge of the rearmost section 30, rigidly holding the section 30 as a curved plane to enhance the puzzle's three dimensional visual effect. The other two sections 31, 32 are held by separator elements 36, further illustrated in FIG. 11. The base plate 33 has holes 35 that engage a downwardly extending support 39, as illustrated in FIG. 12. The separator elements 36 also have upwardly extending members 38 that engage slots 42 and rigidly grasp the two forward sections 31, 32. The base plate 33 and separator elements 36 cooperate to rigidly hold the puzzle sections 30, 31, 32 in a three dimensional spaced relationship, as illustrated in FIG. 13, to form the assembled puzzle 40. The base plate 33 may also bear a pictorial image that cooperates with the images on the upright sections 30, 31, 32 to produce a three dimensional visual effect, as illustrated in FIG. 16. A puzzle section can also be supported as a curved plane by engaging an edge of the section in a curved segment of molded or extruded channel with a U-shaped cross section.

Figure 14:
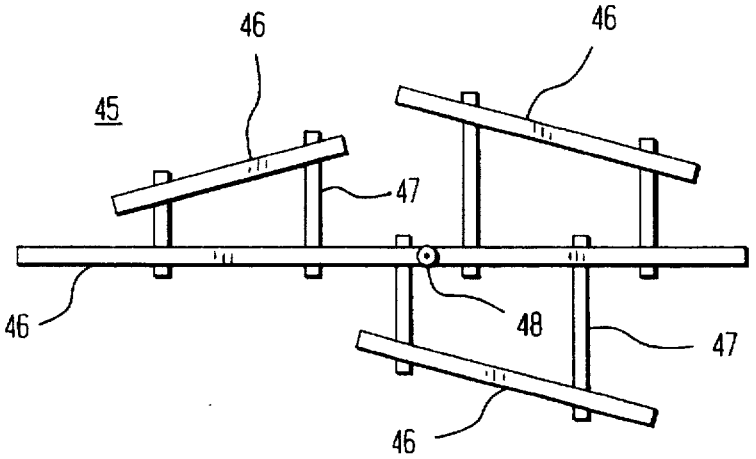
FIG. 14 is a top view of an exemplary puzzle of the invention with angled sections and adapted for use as a mobile.

FIG. 14 shows a top view of a multilayer puzzle 45 showing the top edges of the layers 46. The layers 46 are supported in a three dimensional spaced relationship by the separator elements 47. Here the separator elements are dimensioned to hold the sections 46 at an angle to one another to enhance the three dimensional visual effect produced by the puzzle 45. A support 48 is provided so that the puzzle 45 can be hung as a mobile. For such an application, the three dimensional effect would be further enhanced by imprinting both sides of one or more of the sections 46, with appropriate pictorial images to cooperate in presenting a unified three dimensional impression when viewed from all perspectives. Imprinting both sides would also add to the challenge of assembling the puzzle pieces.

Figure 15:
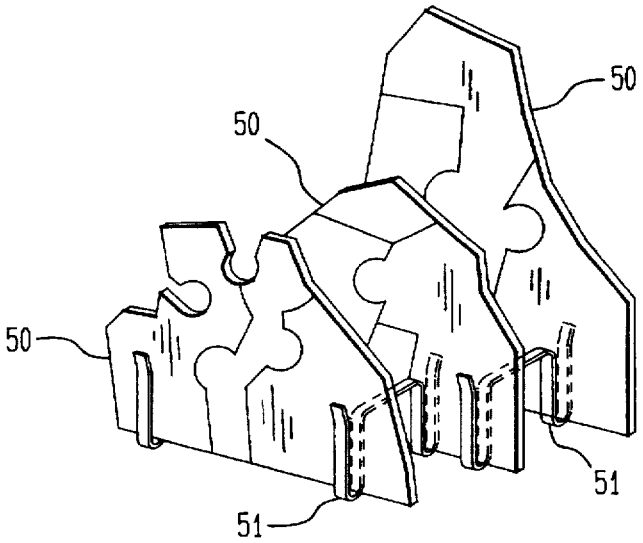
FIG. 15 is a perspective view of a portion of an exemplary puzzle of the invention rigidly supported by spring clips.

FIG. 15 shows portions 50 of three puzzle sections separated by bent metal clips 51. Each clip 51 holds two sections 50 and are staggered to rigidly hold the three sections 50 in spaced relationship.

What is claimed is:

1. A multilayer three dimensional puzzle comprising:

(a) a plurality of interlocking planar puzzle pieces assemblable into at least a first planar section bearing a first pictorial image and a second planar section bearing a second pictorial image, and (b) separator means for rigidly supporting at least the first planar section and the second planar section in a three dimensionally spaced relationship to one another, consisting essentially of a plurality of members selected from the group consisting of thin rods, molded plastic members, molded metal members, bent metal members, and stamped metal members, whereby the first pictorial image and the second pictorial image cooperate to produce a three dimensional visual effect.

2. A puzzle of claim 1 including at least a third planar section.

3. A puzzle of claim 1 in which the reverse of the first planar section bears a third pictorial image and the reverse of the second planar section bears a fourth pictorial image, whereby the four pictorial images cooperate to produce a three dimensional affect when viewed from all perspectives.

4. A puzzle of claim 1 in which each of the planar sections defines a flat plane.

5. A puzzle of claim 1 wherein the separator means is adapted for rigidly holding at least one of the planar sections as a curved plane.

6. A puzzle of claim 1 wherein the separator means is adapted for rigidly supporting at least the first planar section and the second planar section at an angle to one another.

7. A puzzle of claim 6 in which the angle is less than 45 degrees.

8. A puzzle of claim 1 in which the separator means comprises a plurality of linear members.

9. A puzzle of claim 1 in which the separator means includes a planar base section with at least one groove adapted for engaging the edge of at least one of the planar sections.

10. A puzzle of claim 9 in which the planar base section bears a fifth pictorial image that cooperates with the first pictorial image and the second pictorial image to produce a three dimensional visual effect.

11. A puzzle of claim 1 in which the separator means comprises a plurality of molded plastic clamps.

12. A puzzle of claim 1 in which the separator means are adapted for adjusting the spaced relationship to accommodate available display space.

13. A multilayer three dimensional puzzle comprising:

(a) a plurality of interlocking planar puzzle pieces assemblable into at least a first planar section bearing a first pictorial image and a second planar section bearing a second pictorial image, and (b) separator means for rigidly supporting at least the first planar section and the second planar section in a spaced relationship to one another, wherein the reverse of the first planar section bears a third pictorial image and the reverse of the second planar section bears a fourth pictorial image, whereby the four pictorial images cooperate to produce a three dimensional affect when viewed from all perspectives.

14. A multilayer three dimensional puzzle comprising:

(a) a plurality of interlocking planar puzzle pieces assemblable into at least a first planar section bearing a first pictorial image and a second planar section bearing a second pictorial image, and (b) separator means for rigidly supporting at least the first planar section and the second planar section in a spaced relationship to one another, wherein the separator means is adapted for rigidly holding at least one of the planar sections as a curved plane, whereby the first pictorial image and the second pictorial image cooperate to produce a three dimensional visual effect.

15. A multilayer three dimensional puzzle comprising:

(a) a plurality of interlocking planar puzzle pieces assemblable into at least a first planar section bearing a first pictorial image and a second planar section bearing a second pictorial image, and (b) separator means for rigidly supporting at least the first planar section and the second planar section in a spaced relationship to one another, wherein the separator means is adapted for rigidly supporting at least the first planar section and the second planar section at an angle to one another, whereby the first pictorial image and the second pictorial image cooperate to produce a three dimensional visual effect.

16. A puzzle of claim 15 in which its angle is less than 45 degrees.

17. A multilayer three dimensional puzzle comprising:

(a) a plurality of interlocking planar puzzle pieces assemblable into at least a first planar section bearing a first pictorial image and a second planar section bearing a second pictorial image, and (b) separator means for rigidly supporting at least the first planar section and the second planar section in a spaced relationship to one another, wherein the separator means comprises a plurality of linear members, whereby the first pictorial image and the second pictorial image cooperate to produce a three dimensional visual effect.

18. A multilayer three dimensional puzzle comprising:

(a) a plurality of interlocking planar puzzle pieces assemblable into at least a first planar section bearing a first pictorial image and a second planar section bearing a second pictorial image, and (b) separator means for rigidly supporting at least the first planar section and the second planar section in a spaced relationship to one another, wherein the separator means includes a planar base section with at least one groove adapted for engaging the edge of at least one of the planar sections and wherein the planar base section bears a fifth pictorial image that cooperates with the first pictorial image and the second pictorial image to produce a three dimensional visual effect.

19. A multilayer three dimensional puzzle comprising: (a) a plurality of interlocking planar puzzle pieces assemblable into at least a first planar section bearing a first pictorial image and a second planar section bearing a second pictorial image, and (b) separator means for rigidly supporting at least the first planar section and the second planar section in a spaced relationship to one another, wherein the separator means comprises a plurality of molded plastic clamps, whereby the first pictorial image and the second pictorial image cooperate to produce a three dimensional visual effect.

20. A multilayer three dimensional puzzle comprising:

(a) a plurality of interlocking planar puzzle pieces assemblable into at least a first planar section bearing a first pictorial image and a second planar section bearing a second pictorial image, and (b) separator means for rigidly supporting at least the first planar section and the second planar section in a spaced relationship to one another, wherein the separator means are adapted for adjusting the spaced relationship to accommodate available display space, whereby the first pictorial image and the second pictorial image cooperate to produce a three dimensional visual effect.

* * * * *